United States Patent [19]

Herrington et al.

[11] Patent Number: 5,020,194

[45] Date of Patent: Jun. 4, 1991

[54] LEAKPROOF ZIPPER WITH SLIDER

[75] Inventors: Fox J. Herrington, Holcomb; Eric A. St. Phillips, Fairport, both of N.Y.

[73] Assignee: Mobil Oil Corporation, Fairfax, Va.

[21] Appl. No.: 490,112

[22] Filed: Mar. 7, 1990

[51] Int. Cl.[5] ..... A44B 19/16

[52] U.S. Cl. ..... 24/400; 24/389

[58] Field of Search ..... 29/399, 400, 389, 587; 156/66; 383/64, 69

[56] References Cited

U.S. PATENT DOCUMENTS

| | | | |
|---|---|---|---|
| 3,054,434 | 9/1962 | Ausnit et al. | 24/399 X |
| 3,203,062 | 8/1965 | Ausnit | 24/400 |
| 3,220,076 | 11/1965 | Ausnit et al. . | |
| 3,259,951 | 7/1966 | Zimmerman | 24/399 |
| 3,266,112 | 8/1966 | Heckman | 24/400 |
| 3,347,298 | 10/1967 | Ausnit et al. . | |
| 3,426,396 | 2/1969 | Laguerre . | |
| 3,443,671 | 5/1969 | Pyke | 24/400 X |
| 3,462,332 | 8/1969 | Goto . | |
| 3,634,913 | 1/1972 | Ausnit | 24/400 |
| 3,660,875 | 5/1972 | Gutman . | |
| 3,713,923 | 1/1973 | Laguerre . | |
| 3,790,992 | 2/1974 | Herz . | |
| 3,806,998 | 4/1974 | Laguerre . | |
| 4,736,451 | 4/1988 | Ausnit . | |

*Primary Examiner*—James R. Brittain

*Attorney, Agent, or Firm*—Alexander J. McKillop; Charles J. Speciale

[57] ABSTRACT

A leakproof plastic reclosable fastener or zipper with slider particularly suited for thermoplastic bags. The zipper is formed by reclosable interlocking rib and groove profile elements on respective strips and the strips each include profiled track structure extending along the length thereof parallel to the rib and groove elements. A straddling slider is positioned on the strips for closing or opening the reclosable fastener elements. The slider includes depending side walls for maintaining the track structure and the rib and groove elements therebetween. The slider also includes separator structure inserted between the track structure but not the rib and groove elements to open the rib and groove elements. The zipper structure is slit or notched locally at the end where the slider goes when the zipper is closed, to allow the rib and groove elements to interlock fully making a leakproof closure.

9 Claims, 6 Drawing Sheets

LEAKPROOF ZIPPER WITH SLIDER

BACKGROUND OF THE INVENTION

The present invention relates to improvements in plastic reclosable fasteners with sliders particularly suited for thermoplastic bags and the like and particularly to a zipper slider having separator structure that acts on track structure extending along the length and parallel to the rib and groove elements of the zipper and not between the rib and groove elements as with a conventional zipper. The zipper structure is slit or notched locally at the end where the slider goes when the zipper is closed, to allow the rib and groove elements to interlock fully, making a leakproof closure.

Conventional plastic profile zipper bags use a pair of interlocking profile zipper elements but without a slider. It is possible to close the zipper elements completely across the bag thereby producing a leakproof closure for the bag. Profile zippers with sliders are used on plastic bags, brief cases, etc. Examples of such profile zippers with sliders are made by Flexico—France, Henonville, France and Baron Industries, Inc. New York, N.Y. The separator tab or finger on the slider goes between the zipper elements so that the zipper is always held open for at least a small portion of its length. Such a zipper is not leak-proof. Examples of such zippers or plastic reclosable fasteners and sliders are disclosed in U.S. Pat. Nos. 3,426,396, 3,660,875, 3,713,923, 3,790,992 and 3,806,998. A flexible fastener with unidirectional opening with a slider is shown in U.S. Pat. No. 3,347,298.

RELATED APPLICATIONS

A method of assembling a metal slider with a plastic reclosable fastener is disclosed in related application entitled "Method of Assembling Metal Slider with a Plastic Reclosable Fastener" Ser. No. 490,114 filed concurrently herewith and incorporated herewith by reference thereto. A method of assembling a plastic slider with a plastic reclosable fastener is disclosed in related application entitled "Method of Assembling a Snapped Together Multi-Part Plastic Slider with a Plastic Reclosable Fastener", Ser. No. 490,107 filed concurrently herewith and incorporated herein by reference thereto. Another method of assembling a plastic slider with a plastic reclosable fastener is disclosed in related application entitled "Method of Assembling a Multi-Part Plastic Slider with a Plastic Reclosable Fastener by Ultrasonic Welding" Ser. No. 490,109 filed concurrently herewith and incorporated herein by reference thereto. A foldable plastic slider for a zipper is disclosed in related application entitled "Foldable Plastic Slider and Method of Assembly with a Plastic Reclosable Fastener", Ser. No. 490,108 filed concurrently herewith and incorporated herein by reference thereto. Another foldable plastic slider for a plastic zipper is disclosed in related application entitled "Gull Wing Zipper Slider", Ser. No. 490,106 filed concurrently herewith and incorporated herein by reference thereto. Another zipper profile with plastic slider is disclosed in related application entitled "Rolling Action Zipper Profile and Slider Therefor", Ser. No. 490,110 filed concurrently herewith and incorporated herein by reference thereto. All of the above-identified related applications and the present application are assigned to the same assignee.

SUMMARY OF THE INVENTION

The present invention relates to a leakproof plastic reclosable fastener with slider particularly suited for thermoplastic bags and the like comprising a pair of flexible plastic strips having separable fastener means extending along the length thereof comprising reclosable interlocking rib and groove profile elements on the respective strips. The strips each include profiled track structure extending along the length thereof parallel to the rib and groove elements. A straddling slider is positioned on the strips for closing or opening the reclosable fastener elements. The slider comprises an inverted U-shaped plastic member having a back for moving along the top edges of the strips with depending side walls projecting therefrom for maintaining the track structure and the rib and groove elements therebetween. The slider includes separator structure depending from the back and inserted between the track structure to open the rib and groove elements. The side walls extend from an opening end of the slider to a closing end. The side walls are spaced wider apart at the opening end to permit separation of the rib and groove elements and are spaced sufficiently close together at the closing end to press the rib and groove elements into interlocking relationship as the slider is moved in a fastener closing direction. Structure is provided at one end of the pair of strips separating the track structure from the interlocking rib and groove elements whereby when the slider is moved in the fastener closing direction to the one end of the strips the opening end of the slider is ineffective on the track structure to open the interlocking rib and groove elements at that one end of the strips while the interlocking rib and groove elements are closed throughout the length of the strips to prevent leakage through the reclosable fastener.

In accordance with one aspect of the invention the structure at the one end of the pair of strips separating the track structure from the interlocking rib and groove elements comprises longitudinal slit structure.

In accordance with another aspect of the invention the structure at the one end of the pair of strips separating the track structure from the interlocking rib and groove elements comprises notch structure.

In accordance with another aspect of the invention the profiled track structure is positioned above the interlocking rib and groove profile elements.

In another form of the invention the profiled track structure extends along opposite sides of the interlocking rib and groove profile elements.

In accordance with a further aspect of the invention, the separator structure depending from the back and inserted between the profiled track structure is substantially wedge shaped.

In accordance with another aspect of the invention the structure depending from the back of the slider includes shoulder structure extending outwardly for engaging the bottom of the track structure.

In accordance with another aspect of the invention the separator structure includes groove structure on opposite sides of the slider for receiving the profiled track structure.

In accordance with another aspect of the invention the depending side walls include shoulder structure extending inwardly and beneath the interlocking rib and groove profile elements for maintaining the slider on the pair of flexible plastic strips.

Other objects and advantages of the invention will become apparent from the following detailed description of the invention taken in conjunction with the accompanying drawings.

PREFERRED EMBODIMENTS OF THE INVENTION

Figure 1:
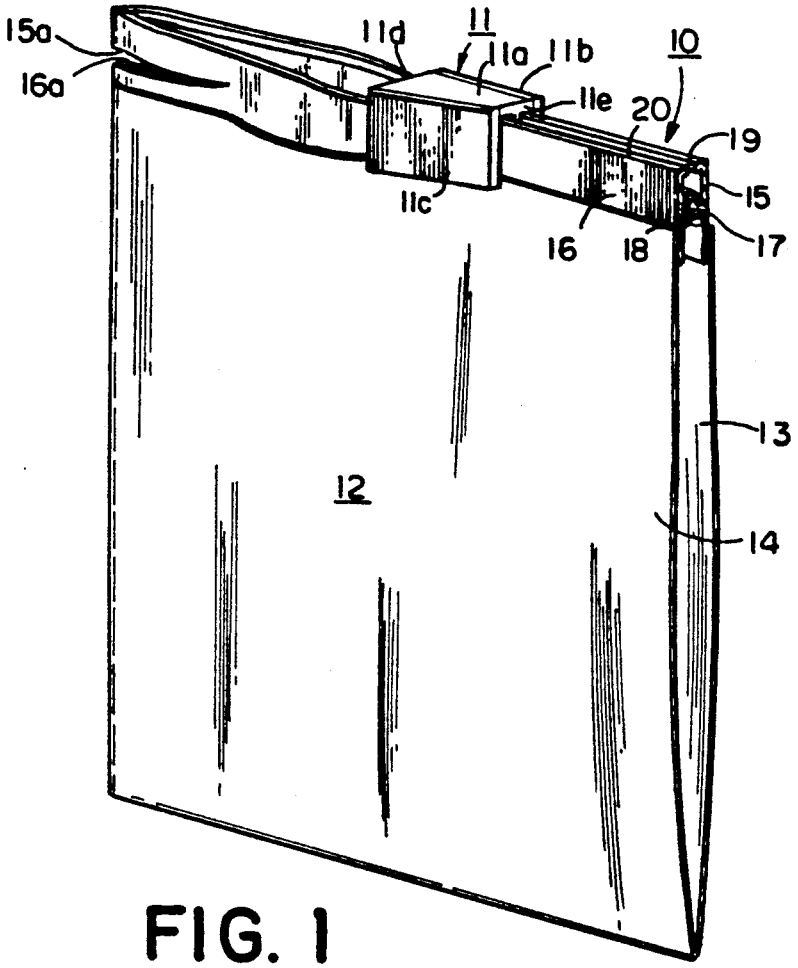
FIG. 1 is a perspective view of a thermoplastic bag or the like having a leakproof plastic reclosable fastener with slider embodying the present invention.

Referring to FIG. 1, there is illustrated a leakproof plastic reclosable fastener 10 commonly referred to as a zipper with a slider 11 particularly suited for thermoplastic bags and the like and has been illustrated in FIG. 1 in connection with a thermoplastic bag 12. The bag 12 has been cut away at the right hand end for clarity. The bag 12 may be made from any suitable thermoplastic film such for example as polyethylene or polypropylene or equivalent material. The bag 12 is formed by a pair of flexible plastic sheets 13 and 14 having a top edge with the reclosable fastener means 10 along the length thereof. The reclosable fastener means 10 comprises a pair of flexible strips 15 and 16 having separable fastener means extending along the length thereof comprising reclosable interlocking rib and groove profile elements 17 and 18 on the respective strips 15 and 16. The strips 15 and 16 each include profiled track structure 19 and 20 extending along the length thereof parallel to the rib and groove elements 17 and 18. The flexible plastic strips 15 and 16 extend along the mouth of the bag 12 and are adapted to be secured in any suitable manner to the flexible walls of the thermoplastic film bag. While the strips may be integral marginal portions of such walls, it is preferable that they be extruded separately and thereafter attached to the walls along the mouth of the bag in a manner well known in the art. The manner of attaching these strips to the respective walls of the bag is well known and does not form part of the present invention.

As may be seen in FIGS. 1–4 and 7 the slider 11 straddles the strips 15 and 16 for closing or opening the reclosable fastener elements 17 and 18. The slider 11 comprises an inverted U-shaped plastic member having a back **11*a* for moving along the top edges of the strips with depending side walls 11*b*, 11*c* projecting therefrom for maintaining the track structure 19 and 20 and the rib and groove elements 17 and 18 therebetween and extending from an opening end 11*d* of the slider 11 to a closing end 11*e*. The side walls 11*b*, 11*c*, are spaced wider apart at the opening end 11*a* to permit separation of the rib and groove elements 17 and 18 and are spaced sufficiently close together at the closing end 11*e* of the slider to press the rib and groove elements 17 and 18** into interlocking relationship as the slider is moved in a fastener closing direction.

Figure 2:
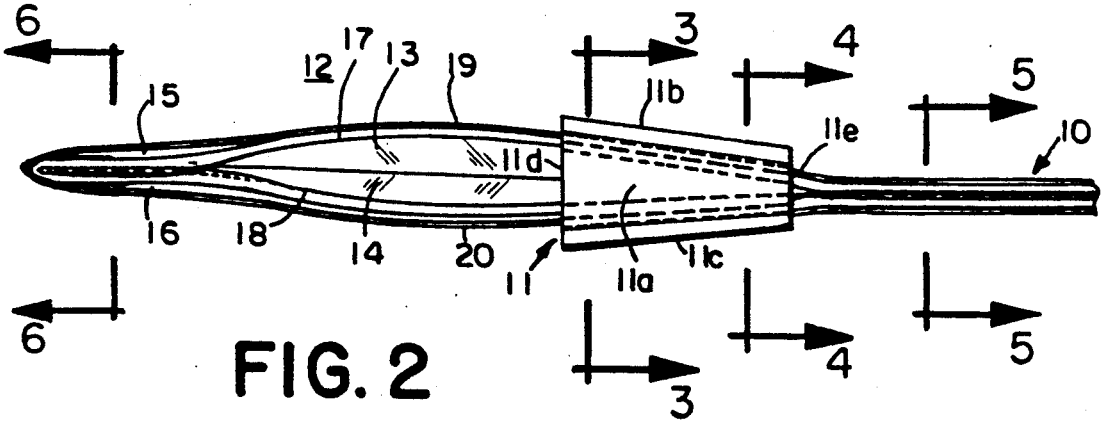
FIG. 2 is a top plan view on enlarged scale of the slider and reclosable fastener shown in FIG. 1.
Figure 3:
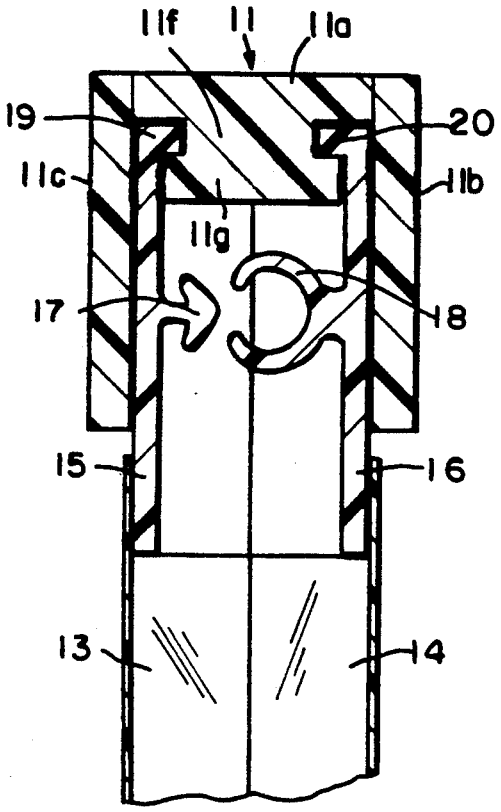
FIG. 3 is a sectional view taken along the lines 3—3 in FIG. 2.
Figure 4:
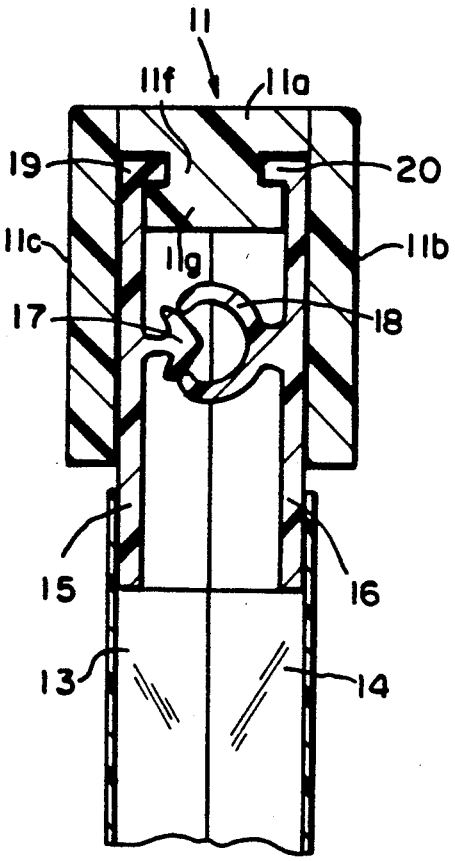
FIG. 4 is a sectional view taken along the lines 4—4 in FIG. 2.
Figure 5:
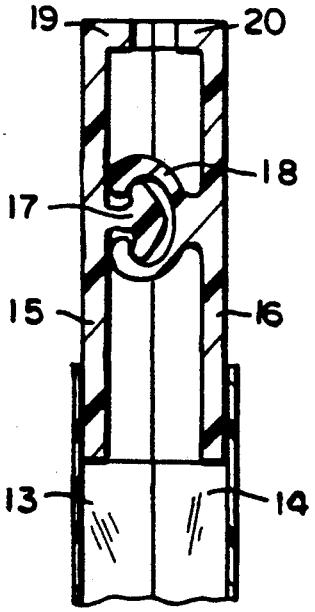
FIG. 5 is a sectional view taken along the lines 5—5 in FIG. 2.
Figure 6:
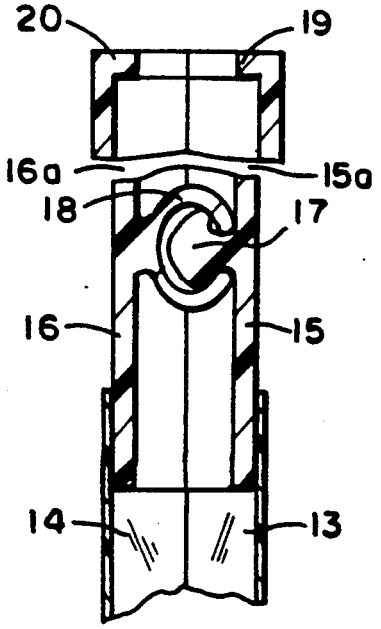
FIG. 6 is a sectional view taken along the lines 6—6 in FIG. 2.
Figure 7:
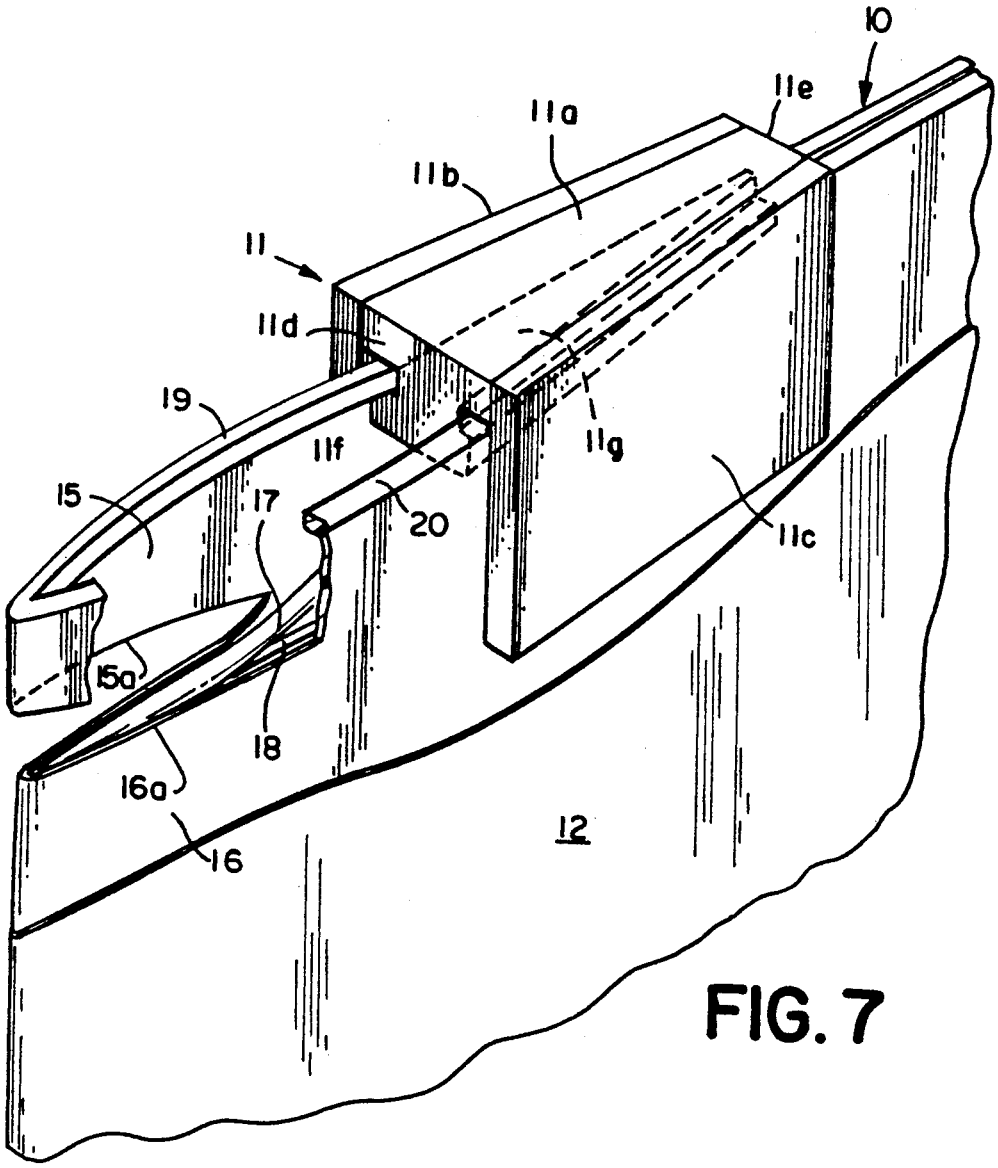
FIG. 7 is a fractional perspective view on enlarged scale of the leakproof plastic reclosable fastener with slider taken from the opposite end of the bag from that shown in FIG. 1.

The slider 11 is provided with depending separator structure in the form of a plastic finger **11*f* which extends between the side walls 11*b* and 11*c* of the slider 11 for separating the rib and groove elements 17 and 18 as the slider 11 is moved in a fastener opening direction, FIGS. 3 and 4. The finger 11*f* is inserted between the tracks 19 and 20 which are integral with the rib and groove elements 17 and 18. As may be seen in FIGS. 2–4 and 7 the separating finger 11*f* is of wedge-shaped construction with the wider end of the wedge at the opening end 11*d* of the slider 11. The separating finger 11*f* is provided at its lower end with outwardly extending shoulder structure 11*g*, FIGS. 3 and 4, for engaging the bottom of the tracks 19 and 20 to prevent the slider 11 from being lifted off the top edge of the fastener while the slider straddles the fastener as shown in FIGS. 1–4 and 7. The tracks 19 and 20 are integral with the rib 17 and groove 18 on the respective strips 15 and 16 when the wedge 11*f* moves the tracks 19 and 20 apart as the slider 11 moves in the opening direction the rib 17 and groove 18 likewise are moved apart to open the zipper. When the slider 11 is moved in the closing direction the side walls 11*b* and 11*c* act on the sides of the strips 15 and 16 to press the rib and groove elements 17 and 18 into interlocking relationship as shown in FIGS. 3–5. The rib and groove elements 17 and 18 are shown in fully closed position in FIG. 5. Since the finger 11*f* is wider at the opening end 11*d* of the slider 11 it continues to move the track structure 19 and 20 apart as it is moved in the closing direction, FIGS. 1, 2 and 7. In order to prevent the slider from opening the interlocking rib and groove elements at the left hand end of the bag as the fastener is being closed, structure is provided at the one end of the pair of strips separating the track structure from the interlocking rib and groove elements whereby when the slider is moved in the fastener closing direction to the one end of the strips, the opening end of the slider is ineffective on the track structure to open the interlocking rib and groove elements at the one end of the strips while the interlocking rib and groove elements are closed throughout the length of the strips by the closing end of the slider to prevent leakage through the reclosable fastener. As shown in FIGS. 1, and 7 this structure is in the form of longitudinal slit structure 15***a* and 16*a* in each of the strips 15 and 16 at the left hand end of the zipper 10 where the slider 11 goes when the zipper 10 is closed. It will be noted that the slits 15*a* and 16*a* separate the tracks 19 and 20 from the rib and groove elements 17 and 18 and thus render the finger 11*f* of the slider ineffective in opening the rib and groove elements 17 and 18 at the closed end of the zipper, FIG. 6. The rib and groove elements 17 and 18 at the left hand end of the bag may initially be closed manually and once closed they remain closed as shown in FIGS. 2, 6 and 7 even when the slider 11 has been moved to the left hand end of the bag.

Figure 15:
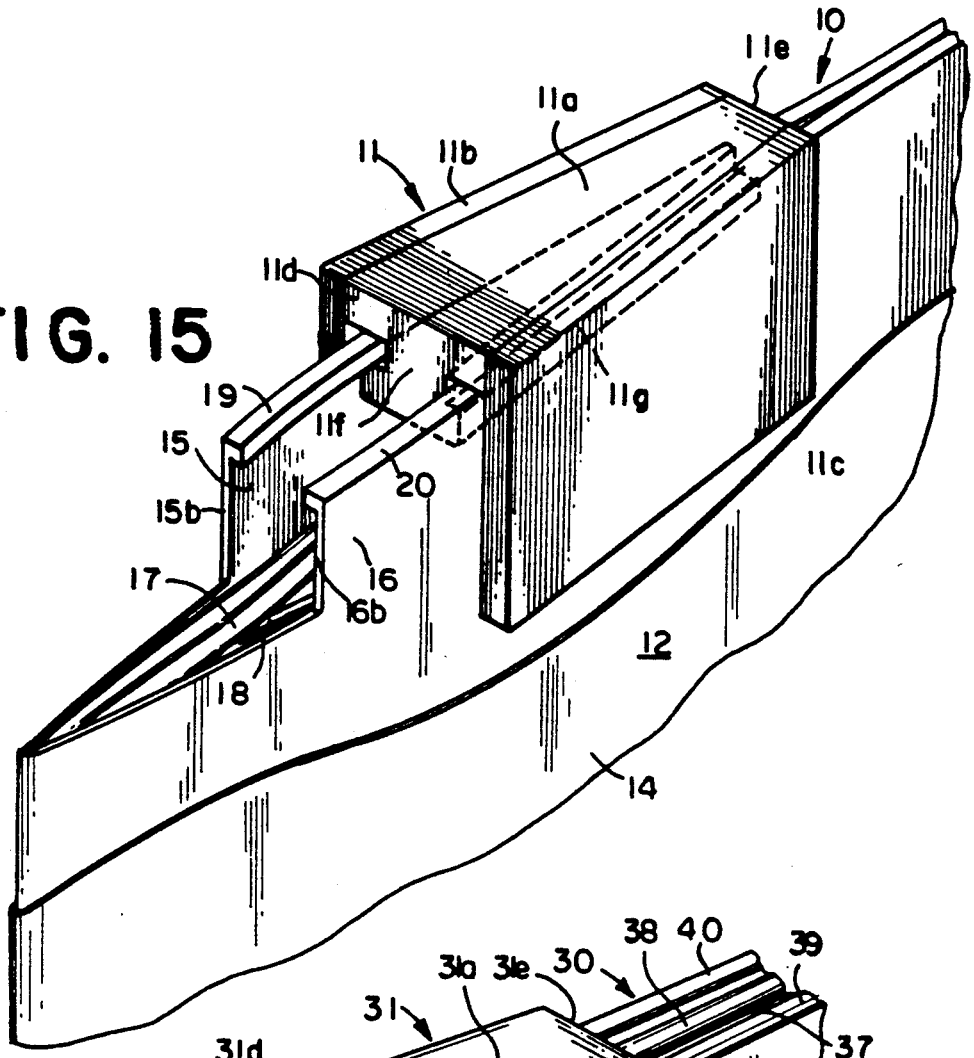
FIG. 15 is a fractional perspective view of a thermoplastic bag or the like of another embodiment of a leakproof plastic reclosable fastener with slider embodying the present invention.

Alternative structure for separating the track structure 19 and 20 from the interlocking rib and groove elements 17 and 18 on the strips is 15 and 16 illustrated in FIG. 15 where notch structure 15*b* and 16*b* has been provided in the respective strips 15 and 16. The notch structure 15*b* and 16*b* separates the tracks 19 and 20 from the interlocking rib and groove elements 17 and 18 at the one end of the pair of strips whereby when the slider 11 is moved in the fastener closing direction to that end of the strips the opening end 11*d* of the slider 11 is ineffective on the track structure 19 and 20 to open the interlocking rib and groove elements 17 and 18 at that end of the strips 15 and 16 while the interlocking rib and groove elements 17 and 18 are closed throughout the length of the strips by the closing end 11*e* of the slider to prevent leakage through the reclosable fastener.

Figure 8:
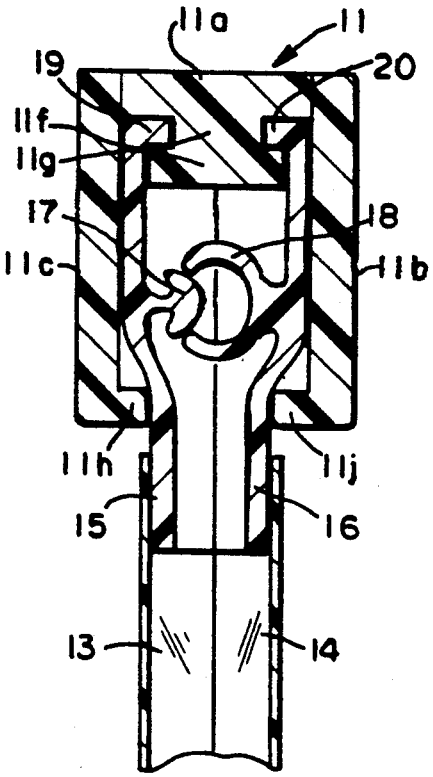
FIG. 8 is a vertical sectional view, similar to FIG. 4, through another embodiment of a leakproof plastic reclosable fastener with slider.
Figure 9:
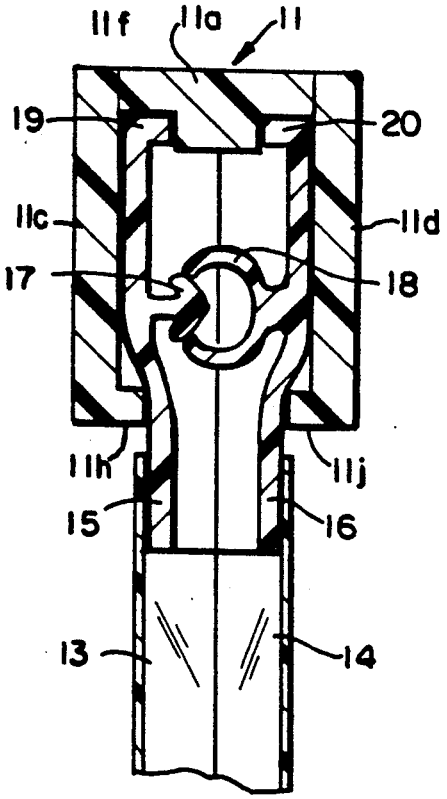
FIG. 9 is a vertical sectional view, similar to FIG. 8, through another embodiment of a lead-proof plastic reclosable fastener with slider embodying the present invention.

The slider 11 has been illustrated as being formed from multiple plastic parts comprising the back 11*a* and separator finger 11*f* and the side walls 11*b* and 11*c*. The plastic parts are molded from a plastic that can be ultrasonically welded such for example as nylon, polypropylene, polystyrene, Delrin or ABS. Other types of plastic sliders may be utilized such for example as the plastic sliders disclosed in the above-identified related applications including the applications disclosing the one piece sliders with foldable side walls. The lower edges of the side walls 11*c* and 11*b* may be provided with shoulders 11*h* and 11*j* extending inwardly and beneath the interlocking rib and groove profile elements 17 and 18 for maintaining the slider 11 on the pair of flexible plastic strips 15 and 16 as shown in FIG. 8. When the shoulders 11*h* and 11*j* are provided on the sidewalls 11*c* and 11*b* the shoulder structure 11*g* on the lower end of the finger 11*f* may be eliminated if desired. An example of this arrangement is illustrated in FIG. 9.

Figure 14:
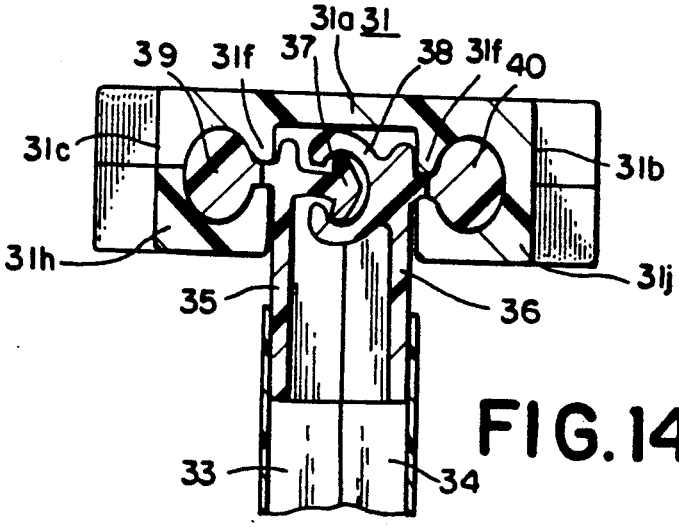
FIG. 14 is a view taken along the lines 14—14 in FIG. 12.
Figure 10:
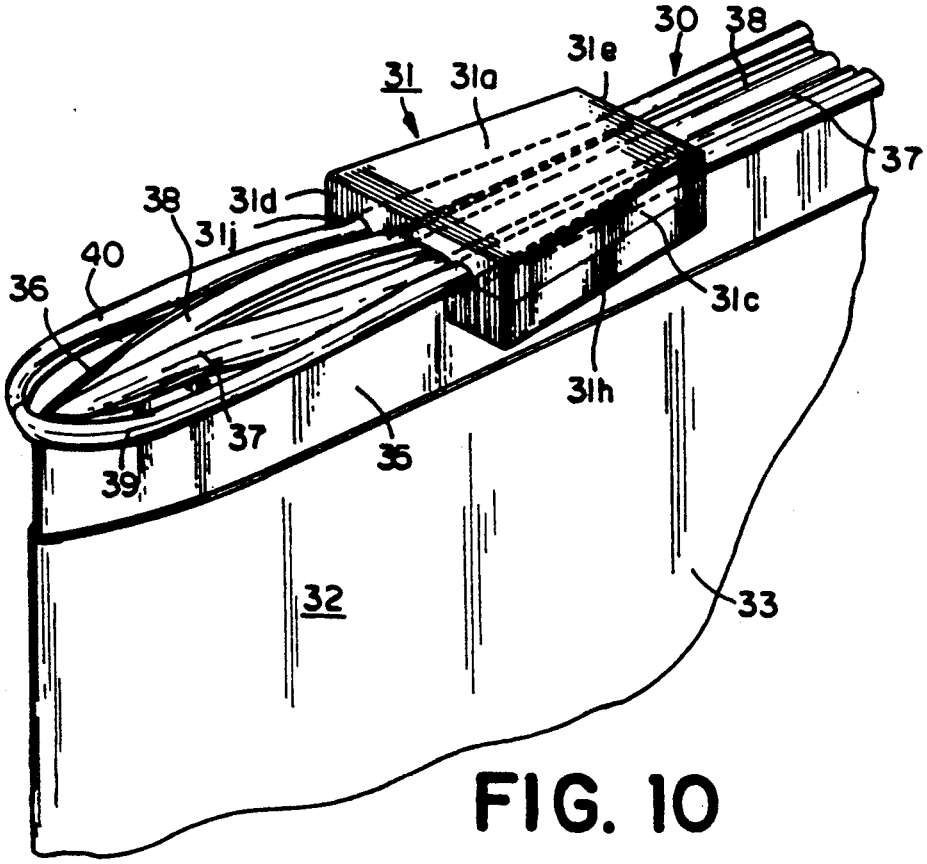
FIG. 10 is a fractional perspective view of a thermoplastic bag or the like of another embodiment of a leakproof plastic reclosable fastener with slider according to the present invention.
Figure 11:
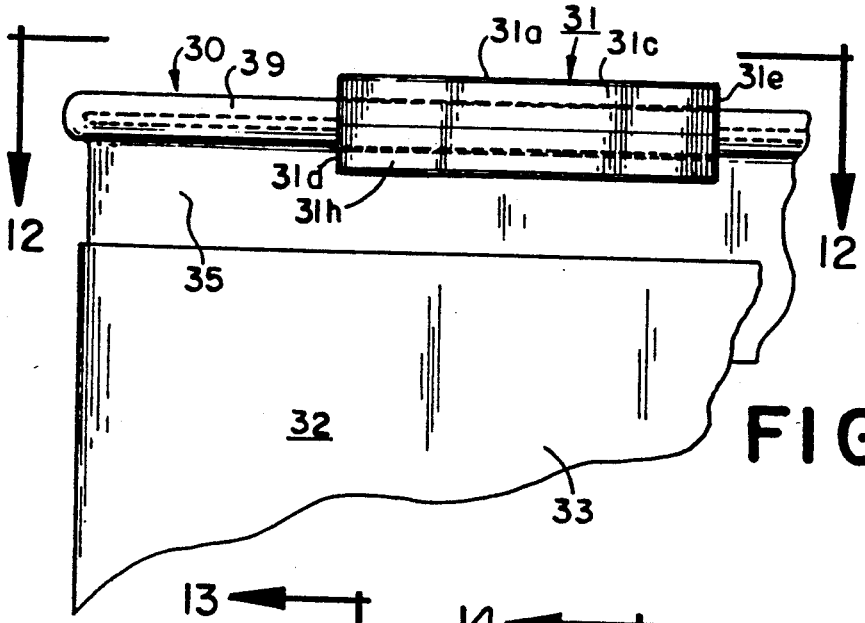
FIG. 11 is a side elevation of the leakproof plastic reclosable fastener with slider shown in FIG. 10.

Referring to FIG. 10 there is illustrated a modification of a leakproof plastic reclosable fastener or zipper 30 with a slider 31 particularly suited for thermoplastic bags and the like and has been illustrated in FIG. 10 in connection with a thermoplastic bag 32. As hereinafter described it will be recognized that the reclosable fastener 30 and the slider 31 are similar to the fastener 10 and the slider 11 previously disclosed in connection with FIGS. 1–9 and 15. The bag 32 is formed by a pair of flexible plastic film sheets 33 and 34, FIGS. 13 and 14 having a top edge with a reclosable fastener means 30 extending along the length thereof. The reclosable fastener means 30 comprises a pair of flexible strips 35 and 36 having separable fastener means extending along the length thereof comprising reclosable interlocking rib and groove profiled elements 37 and 38 on the respective strips 35 and 36. The strips 35 and 36 each include profiled track structure 39 and 40 extending along the length thereof parallel to the rib and groove elements 37 and 38. As may be seen in FIGS. 10–14 the profiled track structure 39 and 40 extends along opposite sides of the interlocking groove and profile elements 37 and 38. The flexible plastic strips 35 and 36 extend along the mouth of the bag 32 and are adapted to be secured in any suitable manner to the flexible walls of the thermoplastic bag. It is preferable that the strips be extruded separately and thereafter attached to the walls along the mouth of the bag in a manner well known in the art.

As may be seen in FIGS. 10–14 the slider 31 straddles the strips 35 and 36 for closing or opening the reclosable fastener elements 37 and 38. The slider 31 comprises an inverted U-shaped plastic member having a back 31*a* for moving along the top edges of the strips with depending side walls 31*b*, 31*c* projecting therefrom for maintaining the track structure 39 and 40 and the rib and groove elements 37 and 38 therebetween and extending from an opening end 31*d* of the slider 31 to a closing end 31*e*, FIGS. 10 and 12. The side walls 31*b*, 31*c* are spaced wider apart at the opening end 31*d* to permit separation of the rib and groove elements 37 and 38 and are spaced sufficiently close together at the closing end 31*e* of the slider to press the rib and groove elements 37 and 38 into interlocking relationship, FIG. 13, as the slider is moved in the fastener closing direction.

The slider 31 is provided with depending separator structure 31*f*, 31*f* which extends between the side walls 31*b* and 31*c* of the slider 31 for separating the rib and groove elements 37 and 38 as the slider 31 is moved in the fastener opening direction. As may be seen in FIG. 14 the separator structure 11*f* is inserted between the tracks 39 and 40 which are integral with the rib and groove elements 37 and 38. As may be seen in FIGS. 10 and 12 the separator structure 31*f* is of wedge-shaped construction with the wider end of the wedge at the opening end 31*d* of the slider 31. The slider 31 is provided with a lower section 31*h*, 31*j*, FIGS. 10, 11, 13 and 14, for engaging the bottom of the tracks 39 and 40 to prevent the slider 31 from being lifted off the top edges of the fastener while the slider straddles the fastener as shown in FIGS. 10–14. As may be seen in FIGS. 13 and 14 the section 31*h* is connected to the lower end of the side wall 31*c* and forms an inwardly extending shoulder structure which extends around the bottom of the track 39. Similarly, the section 31*j* is connected to the lower end of the side wall 31*b* and forms inwardly extending shoulder structure which extends around the lower surface of the track 40.

Figure 12:
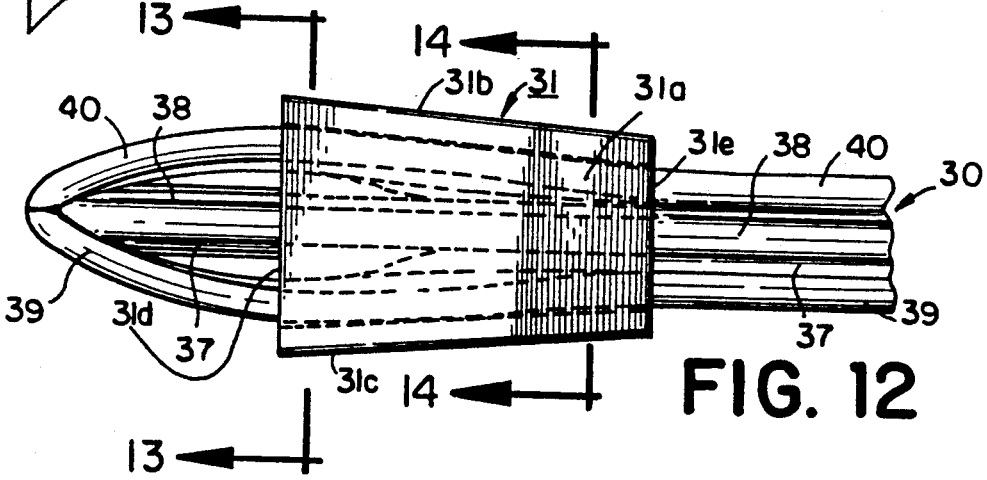
FIG. 12 is a plan view of the leakproof plastic reclosable fastener with slider illustrated in FIG. 11.
Figure 13:
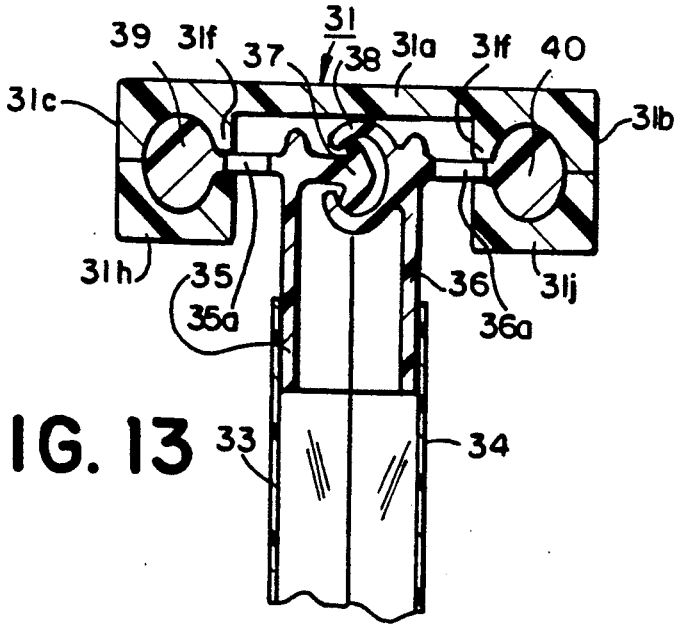
FIG. 13 is a sectional view taken along the lines 13—13 in FIG. 12.

The tracks 39 and 40 are integral with the rib 37 and the groove 38 on the respective strips 35 and 36 and when the wedge 31*f* moves the tracks 39 and 40 apart as the slider 31 moves in the opening direction the rib 37 and groove 38 likewise are moved apart to open the zipper. When the slider 31 is moved in the closing direction the side walls 31*b* and 31*c* act on the sides of the tracks 39 and 40 to press the rib and groove elements 37 and 38 into interlocking relationship as shown in FIG. 13. Since the separator or finger structure 31*f* is wide at the opening end 31*d* of the slider 31 it continues to move the track structure 39 and 40 apart as it is moved in the closing direction. In order to prevent the slider 31 from opening the interlocking rib and groove elements 37, 38 at the left hand end of the bag as the fastener 30 is being closed, structure is provided at the left hand end of the pair of strips 35 and 36 separating the track structure 39, 40 from the interlocking rib and groove elements 37, 38 whereby when the slider is moved in the fastener closing direction to the left hand end of the strips, the opening end of the slider is ineffective on the track structure to open the interlocking rib and groove elements at that end of the strips while the interlocking rib and groove elements are closed throughout the length of the strips by the closing end of the slider to prevent leakage through the reclosable fastener. As shown in FIGS. 10, 12 and 13 this structure is in the form of longitudinal slit structure 35*a* and 36*a* in each of the strips 35 and 36 at the left hand end of the zipper 30 where the slider 31 goes when the zipper is closed. It will be noted that the slits 35*a* and 36*a* separate the tracks 39 and 40 from the rib and groove elements 37 and 38 and thus render the separator structure 31*f* of the slider ineffective in opening the rib and groove elements 37 and 38 at the closed end of the zipper. The rib and groove 37 and 38 thus remain closed when the slider has been moved to the left hand end of the bag. This is best seen in FIGS. 12 and 13.

Figure 16:
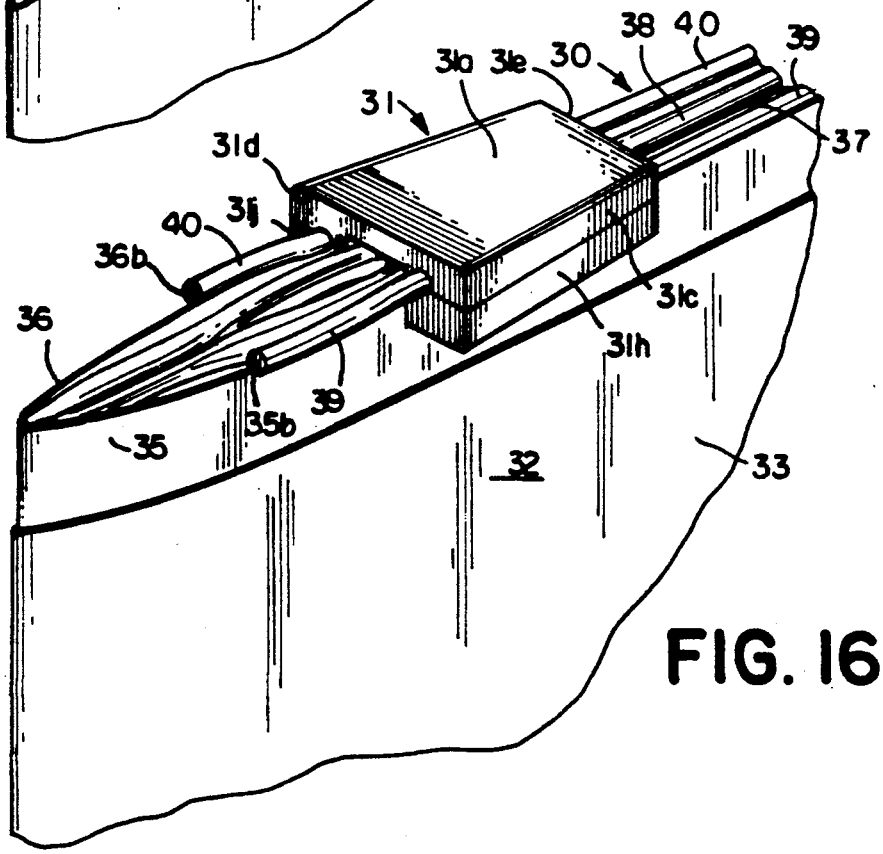
FIG. 16 is a fractional perspective view of a thermoplastic bag or the like of another embodiment of a leakproof plastic reclosable fastener with slider embodying the present invention.

Alternative structure for separating the track structure 39 and 40 from the interlocking rib and groove elements 37 and 38 on the strips 35 and 36 is illustrated in FIG. 16 where notch structure 35*b* and 36*b* has been provided in the respective strips 35 and 36. The notch structure 35*b* and 36*b* separates the tracks 39 and 40 from the interlocking rib and groove element 37 and 38 at the one end of the pair of strips whereby when the slider 31 is moved in the fastener closing direction to that end of the strips the opening end 31*d* at the slider 31 is ineffective on the track structure 39 and 40 to open the interlocking rib and groove elements 37 and 38 at that end of the strips 35 and 36 while the interlocking rib and groove elements 37 and 38 are closed throughout the length of the strips bY the closing end 31*e* of the slider to prevent leakage through the reclosable fastener. The plastic parts of the slider 31 may be molded from a plastic that can be ultrasonically welded such for example as nylon, polypropylene, polystyrene, Delrin or ABS. The bottom section of the slider 31 comprising the parts 31*h* and 31*j* may be ultrasonically welded to the top section or they may be provided with pins and openings so that the parts can be snapped together and assembled on the zipper 30.

While preferred embodiments of the invention have been described and illustrated, it is to be understood that further modifications thereof may be made within the scope of the appended claims without departing from the spirit of the invention.

What is claimed is:

1. A leakproof plastic reclosable fastener with slider particularly suited for thermoplastic bags and the like comprising a pair of flexible plastic strips having separable fastener means extending along the length thereof comprising reclosable interlocking rib and groove profile elements on the respective strips, said strips each including profiled track structure extending along the length thereof parallel to the rib and groove elements, a straddling slider on said strips for closing or opening the reclosable fastener elements comprising an inverted U-shaped plastic member having a back for moving along the top edges of the strips with depending side walls projecting therefrom for maintaining said track structure and said rib and groove elements therebetween, said slider including separator structure depending from said back and inserted between said track structure to open said rib and groove elements, said side walls extending from an opening end of the slider to a closing end, the side walls being spaced wider apart at the opening end to permit separation of the rib and groove elements and being spaced sufficiently close together at the closing end to press the rib and groove elements into interlocking relationship as the slider is moved in a fastener closing direction, and structure at one end of said pair of strips separating said track structure from said interlocking rib and groove elements whereby when said slider is moved in the fastener closing direction to said one end of said strips said opening end of said slider is ineffective on said track structure to open said interlocking rib and groove elements at said one end of said strips while said interlocking rib and groove elements are closed throughout the length of said strips by said closing end of said slider to prevent leakage through said reclosable fastener, wherein said structure at said one end of said pair of strips separating said track structure from said interlocking rib and groove elements comprising longitudinal slit structure whereby when said slider is moved in the fastener closing direction to said one end of said strips said track structure on said strips is moved apart at said at said one end of said strips by said opening end of said slider while said interlocking rib and groove elements are closed throughout the length of said strips by said closing end of said slider to prevent leakage through said reclosable fastener.

2. A leakproof plastic reclosable fastener with slider according to claim 1 wherein said profiled track structure extends parallel to said interlocking rib and groove profile elements.

3. A leakproof plastic reclosable fastener with slider according to claim 2 wherein said profiled track structure is positioned above said interlocking rib and groove profile elements.

4. A leakproof plastic reclosable fastener with slider according to claim 2 wherein said profiled track structure extends along opposite sides of said interlocking rib and groove profile elements.

5. A leakproof plastic reclosable fastener with slider according to claim 4 wherein said separator structure includes groove structure on opposite sides of said slider for receiving the profiled track structure.

6. A leakproof plastic reclosable fastener with slider according to claim 2 wherein said separator structure depending from said back and inserted between said profiled track structure is substantially wedge-shaped.

7. A leakproof plastic reclosable fastener with slider according to claim 6 wherein said separator structure depending from said back of said slider includes shoulder structure extending outwardly for engaging the bottom of the track structure.

8. A leakproof plastic reclosable fastener with slider according to claim 7 wherein said depending side walls include shoulder structure extending inwardly and beneath the interlocking rib and groove profile elements for maintaining the slider on said pair of flexible plastic strips.

9. A leakproof plastic reclosable fastener with slider according to claim 6 wherein said depending side walls include shoulder structure extending inwardly and beneath the interlocking rib and groove profile elements for maintaining the slider on said pair of flexible plastic strips.

* * * * *